US008750764B2

(12) United States Patent
Okuno et al.

(10) Patent No.: US 8,750,764 B2
(45) Date of Patent: Jun. 10, 2014

(54) DEVELOPING DEVICE AND IMAGE FORMING APPARATUS

(75) Inventors: Yuusuke Okuno, Toyokawa (JP); Wataru Watanabe, Hachioji (JP)

(73) Assignee: Konica Minolta Business Technologies, Inc, Chiyoda-Ku, Tokyo (JP)

( * ) Notice: Subject to any disclaimer, the term of this patent is extended or adjusted under 35 U.S.C. 154(b) by 94 days.

(21) Appl. No.: 13/350,076

(22) Filed: Jan. 13, 2012

(65) Prior Publication Data

US 2012/0189349 A1 Jul. 26, 2012

(30) Foreign Application Priority Data

Jan. 20, 2011 (JP) ..... 2011-009498

(51) Int. Cl.
*G03G 15/08* (2006.01)

(52) U.S. Cl.
USPC ..... 399/254; 399/264

(58) Field of Classification Search
USPC ..... 399/254
See application file for complete search history.

(56) References Cited

U.S. PATENT DOCUMENTS

2006/0078354 A1 * 4/2006 Kubota et al. ..... 399/254
2007/0264053 A1 * 11/2007 Iwata et al. ..... 399/254

FOREIGN PATENT DOCUMENTS

JP 2005-221852 A 8/2005
JP 2005-221852 A * 8/2005 ..... G03G 15/08
JP 2008-250290 A 10/2008
JP 2009-036805 A * 2/2009 ..... G03G 15/08

* cited by examiner

*Primary Examiner* — Clayton E Laballe
*Assistant Examiner* — Jas Sanghera
(74) *Attorney, Agent, or Firm* — Buchanan Ingersoll & Rooney PC

(57) ABSTRACT

A trickle-type developing device comprising: a stirring and conveying tank provided with stirring and conveying screws that circulate the developer; a discharge member via which a part of the developer is conveyed from the tank to a discharge opening through which the developer is discharged, the discharge opening being provided in the discharge member; and a reverse flow generating screw provided inside a portion of the discharge member, sharing one of rotation shafts of the stirring and conveying screws, and pushing back a part of the developer, wherein the portion has a reduced-radius part and in a cross section thereof perpendicular to an axial direction of the one of rotation shafts, an inner radius of the portion is smaller in the reduced-radius part than in the remaining part, the reduced-radius part being located in a lower part of the portion with respect to a vertical direction of the portion.

20 Claims, 9 Drawing Sheets

DEVELOPING DEVICE AND IMAGE FORMING APPARATUS

CROSS-REFERENCE TO RELATED APPLICATIONS

This application is based on an application No. 2011-9498 filed in Japan, the contents of which are hereby incorporated by reference.

BACKGROUND OF THE INVENTION (1) Field of the Invention

The present invention is related to a developing device and an image forming apparatus, and in particular to a technology for keeping an amount of developer constant in a trickle-type developing device regardless of a change in a system speed.

(2) Description of the Related Art

In an image forming apparatus using two-component developer, which includes toner and carrier, when toner is consumed in image formation, fresh toner is supplied as required. However, carrier that stays in a developing device degrades over time. In order to lengthen the lifespan of the developing device, despite the degradation of carrier, a trickle-type developing device has been proposed. The trickle-type developing device supplies fresh carrier while discarding degraded carrier little by little. At first, surface overflow types have been in the mainstream of the trickle-type developing devices. The surface overflow type developing devices employ a configuration having two shafts that are laterally aligned and circulate developer, and discharging carrier when the height of a surface of developer exceeds a predetermined level in the developing device.

However, the surface overflow type developing devices have a problem in that an amount of discharged developer easily varies by being influenced by inclination of the developing device in an axial direction of the shafts thereof. That is, when the developing device is inclined so that the height of one end thereof discharging the developer is low, the amount of discharged developer unnecessarily increases, and as a result, carrier that has not particularly degraded is discarded. To the contrary, when the developing device is inclined in the opposite direction, the amount of discharged carrier becomes insufficient, and as a result, degraded carrier stays in the developing device.

In view of the above problem, for example, a technology for locally narrowing the upper part of a clearance at a reverse flow generating unit located in front of a developer discharge opening for discharging the developer is disclosed (see Japanese Patent Application Publication No. 2005-221852). The reverse flow generating unit is provided with a screw for pushing developer in a direction from the developer discharge opening toward a stirring and conveying tank on a path from the stirring and conveying tank to the discharge opening so as to adjust an amount of developer to be discharged. The stirring and conveying tank is for stirring and conveying developer in the developing device.

By narrowing the upper part of a clearance between the screw and an inner wall of the reverse flow generating unit in a vertical direction, an amount of discharged developer becomes dependent more on a driving power to drive the developer in the stirring and conveying tank than on the height of the surface of developer. Accordingly, the amount of discharged developer becomes not likely to be influenced by inclination of the developing device, and stability of the amount of discharged developer is improved. When the amount of discharged developer is stabilized, the amount of developer in the developing device can be kept constant. Accordingly, an amount of toner supplied to a photoreceptor is stabilized and superior image quality is realized.

On the other hand, circulating overflow types are becoming the mainstream of developing devices with a configuration having two screws that are obliquely or vertically aligned and circulate developer in the stirring and conveying tank, and discharging the developer. Such circulating overflow types determine the amount of discharged developer based not only on the driving power to drive developer but also on a relationship between the driving power and a pushing power from the reverse flow generating unit. Also, since the circulating overflow types are unlikely to be influenced by the height of the surface of developer, such types have advantages of being relatively resistant to the inclination of the developing device and being kept compact in size.

Furthermore, with regard to the configuration having the two shafts that are vertically aligned and circulate developer, a technology for ensuring stability to discharge the developer by making downflow openings smaller than an upflow opening is also disclosed (see Japanese Patent Application Publication No. 2008-250290). Such conventional art is provided with a pair of stirring and conveying tanks that are vertically located, two downflow openings, one upflow opening, and a discharge opening. The developer moves down from the upper stirring and conveying tank to the lower stirring and conveying tank through the two downflow openings, and moves up from the lower stirring and conveying tank to the upper stirring and conveying tank through the one upflow opening. The discharge opening is located downstream from the downflow openings of the upper stirring and conveying tank in a conveyance direction of the developer.

One of the two downflow openings allows the developer to traverse at any time, and the other downflow opening allows the developer to traverse only when the amount of developer in the developing device has increased. In addition, the size of each downflow opening is smaller than the size of the upflow opening. Thus, even when an amount of developer in the developing device is small, degraded carrier is discarded while an amount of developer that moves down is limited, and when the amount of developer in the developing device is large, an amount of developer that moves down increases and accordingly an amount of discarded carrier is prevented from being excessive. As a result, it is possible to stabilize an amount of discarded carrier, which has degraded.

In order to increase productivity (the number of images that are formed per unit time) of an image forming apparatus, a system speed has been increasing. In accordance with the increase of the system speed, increase of a stirring and conveying speed of a developing device is also being required in order to supply a greater amount of developer.

However, as the stirring and conveying speed increases, developer that is conveyed jumps the downflow openings more easily due to inertia forces. Especially, when the downflow openings are made narrow like the above conventional art, the developer jumps the downflow openings even more easily, and accordingly an amount of discharged developer increases. As a result, it becomes difficult to stabilize the amount of discharged developer. Such a problem of instability becomes especially evident when a system speed exceeds 200 mm/second.

SUMMARY OF THE INVENTION

The present invention has been achieved in view of the above problem, and a developing device pertaining to the present invention A trickle-type developing device that receives supply of two-component developer including toner, supplies the toner to a photoreceptor, and develops an electrostatic latent image formed on the photoreceptor, the developing device comprising: a stirring and conveying tank provided with stirring and conveying screws that stir, convey and circulate the developer; a hollow cylindrical discharge member via which a part of the developer is conveyed from the stirring and conveying tank to a discharge opening through which the part of the developer is discharged from the discharge member, the discharge opening being provided in the discharge member; and a reverse flow generating screw provided inside a portion of the discharge member, sharing one of rotation shafts of the stirring and conveying screws, and pushing back a part of the developer in a direction from the discharge opening toward the stirring and conveying tank, wherein the portion has a reduced-radius part and in a cross section thereof perpendicular to an axial direction of the one of rotation shafts of the stirring and conveying screws, an inner radius of the portion is smaller in the reduced-radius part than in the remaining part of the portion, the reduced-radius part being located in a lower part of the portion with respect to a vertical direction of the portion.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF PREFERRED EMBODIMENT

An embodiment of a developing device and an image forming apparatus pertaining to the present invention is described below with reference to the drawings.

[1] STRUCTURE OF IMAGE FORMING APPARATUS

First, a structure of an image forming apparatus pertaining to the present embodiment is described below.

Figure 1:
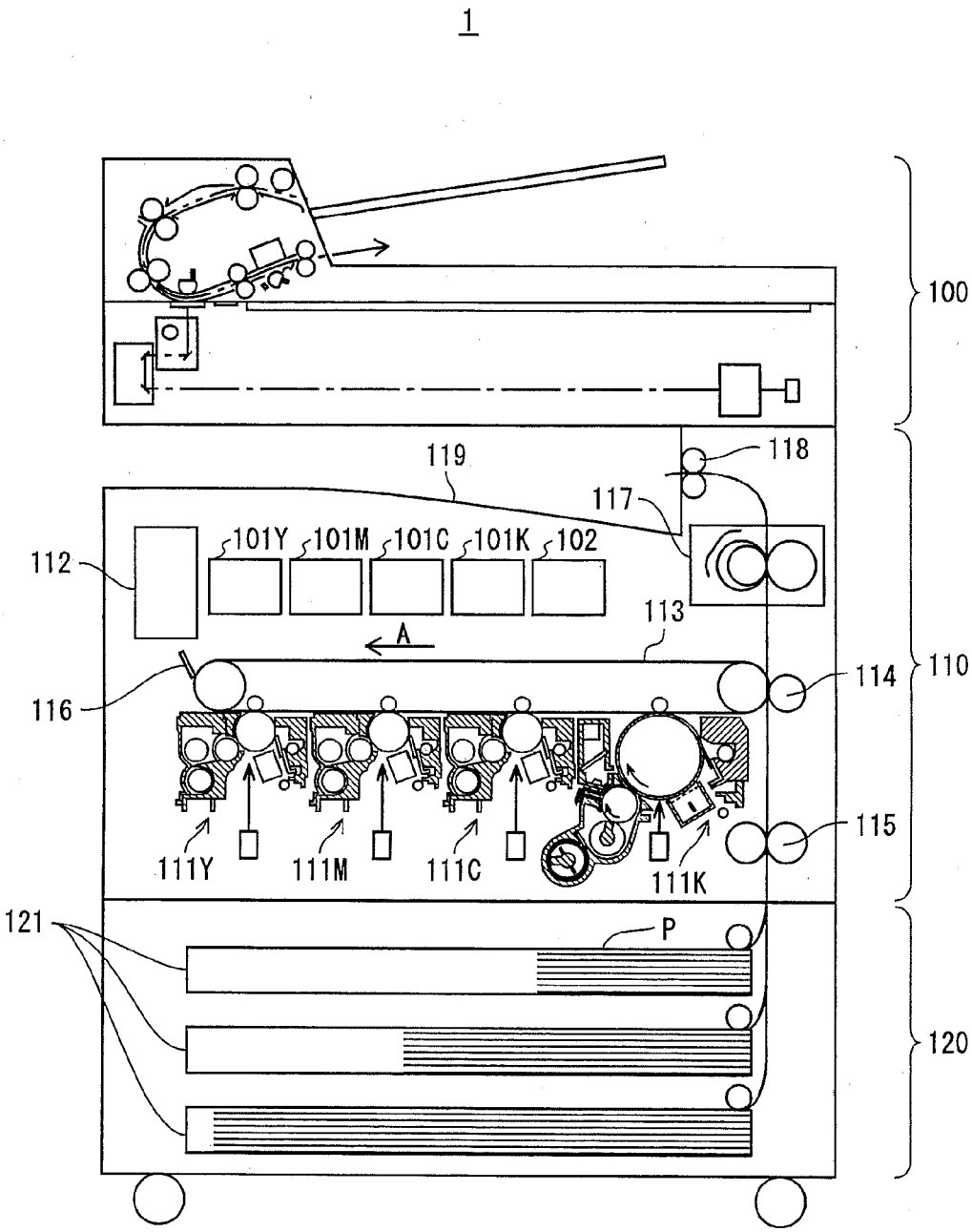
FIG. 1 shows a main structure of an image forming apparatus pertaining to an embodiment of the present invention.

FIG. 1 shows a main structure of the image forming apparatus pertaining to the present embodiment. As shown in FIG. 1, an image forming apparatus 1 includes a document reader 100, an image forming unit 110, and a paper feeder 120. The document reader 100 forms image data by optically reading a document through an Automatic Document Feeder (ADF) taking a document placed on a document tray. The formed image data is stored in a controller 112 described later.

The image forming unit 110 includes imaging units 111Y-111K, the controller 112, an intermediate transfer belt 113, a secondary transfer roller pair 114, a timing roller pair 115, a cleaner 116, a fixing device 117, a sheet discharge roller pair 118, and a sheet discharge tray 119. Furthermore, the image forming unit 110 is provided with toner cartridges 101Y-101K for four colors, yellow (Y), magenta (M), cyan (C), and black (K), respectively, and a carrier cartridge 102 storing carriers therein.

Receiving toner supplied from the toner cartridges 101Y-101K and carriers supplied from the carrier cartridge 102, the imaging units 111Y-111K form toner images in the colors YMCK, respectively, under control of the controller 112. The toner images are electrostatically transferred (primarily transferred) so as to be overlaid on the intermediate transfer belt 113. The intermediate transfer belt 113 is an endless belt that rotates in a direction of an arrow A so as to convey the toner images primarily transferred to the secondary transfer roller pair 114.

The paper feeder 120 includes feeding cassettes 121 that each store therein recording sheets P according to size and feed the recording sheets P to the image forming unit 110. The fed recording sheets P are conveyed one at a time to the secondary transfer roller pair 114 via the timing roller pair 115, in parallel with the intermediate transfer belt 113 that conveys the toner images. The timing roller pair 115 is composed of a pair of rollers, and adjusts a timing at which the recording sheets P reach the secondary transfer roller pair 114.

The secondary transfer roller pair 114 is composed of a pair of rollers, each at a different voltage, and pressed against each other to form a transfer nip portion. At the transfer nip portion, the toner images on the intermediate transfer belt 113 are electrostatically transferred (i.e., secondarily transferred) onto the recording sheets P. The recording sheets P, onto which the toner images have been transferred, are conveyed to the fixing device 117. In addition, after the secondary transfer, residual toner on the intermediate transfer belt 113 is further conveyed in the direction of the arrow A. Thereafter, the residual toner is scraped off by the cleaner 116 and discarded.

The fixing device 117 is an electromagnetic induction-heating type fixing device that heats and fuses the toner images so that the toner images are fixed onto the recording sheets P. The recording sheets P on which the toner images have been fused are discharged on the sheet discharge tray 119 by the sheet discharge roller pair 118. In addition, the controller 112 controls an operation of the image forming apparatus 1 including the above components. Furthermore, the controller 112 transmits/receives image data to/from other apparatuses such as a personal computer (PC), and receives a print job.

Note that when the toner images are transferred, a transfer charger or a transfer belt may be used instead of the transfer roller pair. In addition, when the residual toner on the intermediate transfer belt 113 is removed, a cleaning brush, a cleaning roller and the like may be used instead of the cleaner 116 (cleaning blade). In the fixing device 117, a halogen lamp or a resistance heating element may be used as a heat source, instead of using an electromagnetic induction-heating type fixing device. Also, a fixing and heating body may be roller-shaped or belt-shaped.

[2] STRUCTURE OF IMAGING UNIT 111K

Next, a structure of the imaging unit 111K is described.

Figure 2:
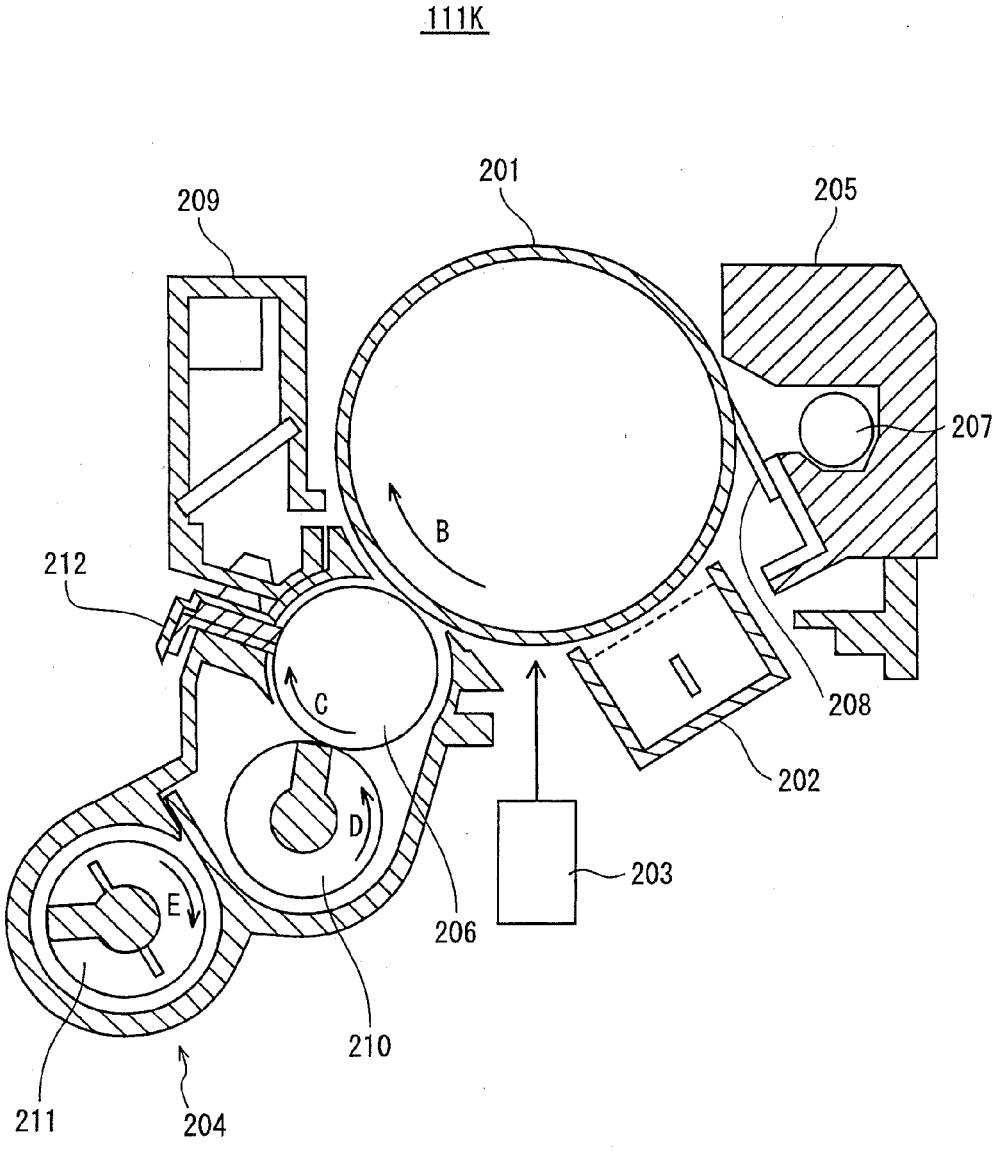
FIG. 2 shows a main structure of an imaging unit 111K.

FIG. 2 shows a main structure of the imaging unit 111K. As shown in FIG. 2, the imaging unit 111K is provided with a photosensitive drum 201, a charging device 202, an exposure device 203, a developing device 204, and a cleaning device 205. The charging device 202, the exposure device 203, the developing device 204, and the cleaning device 205 are disposed around the circumference of the photosensitive drum 201 along a rotation direction of the photosensitive drum 201, in this order from upstream side thereof.

The photosensitive drum 201 is rotated by an unillustrated driving unit in a direction of an arrow B. The charging device 202 uniformly charges the outer circumferential surface of the photosensitive drum 201 by a corona discharge. The exposure device 203 is provided with a semiconductor laser element, and forms an electrostatic latent image on the outer circumferential surface of the photosensitive drum 201 that has been uniformly charged by irradiating a laser beam on the outer circumferential surface of the photosensitive drum 201, under control of the controller 112.

Receiving the fed developer from the toner cartridge 101K via a toner hopper 209, the developing device 204 stirs the developer by a stirring screw 211 to charge toner, and conveys the charged toner to a developing roller 206. The stirring screw 211 rotates in a direction of an arrow E, and a supplying screw 210 rotates in a direction of an arrow D. The developing roller 206 rotates in a direction of an arrow C. Accordingly, the supplying screw 210 rotates in the opposite direction of the developing roller 206.

The developing roller 206 includes a magnet roller fixedly placed within a rotatable sleeve roller. The magnet roller is provided with five magnetic poles N1, S1, N2, N3, and S2 along the direction of the arrow C in this order. Among the above five magnetic poles, the main magnetic pole N1 is placed at a position in opposition to the photosensitive drum 201. In addition, the magnetic poles N2 and N3 facing an inside of the developing device 204 each generate a repulsive magnetic field to remove the developer on the sleeve roller.

The developing roller 206 with the above structure magnetically adsorbs the developer formed by stirring and blending toner and carriers. A regulation board 212 regulates the height of the developer in a spicate form, which has been magnetically adsorbed to the developing roller 206, and prevents a fog or dispersion of toner. A developing bias is applied to the developing roller 206 from an unillustrated power source. The developing bias makes an electrostatic attraction exert an effect on toner, and then the developing device 204 supplies the toner to the outer circumferential surface of the photosensitive drum 201 so that the electrostatic latent image is developed (visualized).

The cleaning device 205 exposes the photosensitive drum 201 with use of an eraser lamp 207 to remove charge from the outer circumferential surface of the photosensitive drum 201. Thereafter, a cleaning blade 208 is made to come in contact with the outer circumferential surface of the photosensitive drum 201 so as to mechanically scrape the outer circumferential surface of the photosensitive drum 201 and remove toner that remains on the outer circumferential surface of the photosensitive drum 201 after the primary transfer. Image formation is successively performed by repeating operations described above.

Note that a photosensitive belt may be used instead of the photosensitive drum 201. Also, the charging device 202 may be a roller-shaped charging type charging device, a charging blade, a charging brush, a closely-located charging member, etc. instead of a corona discharge type charging device. Also, the cleaning device 205 can be a brush, roller, etc. instead of the cleaning blade 208. Also, residual toner may be collected with use of the developing device 204.

[3] STRUCTURE OF DEVELOPING DEVICE 204

Next, a structure of the developing device 204 is described.

Figure 3:
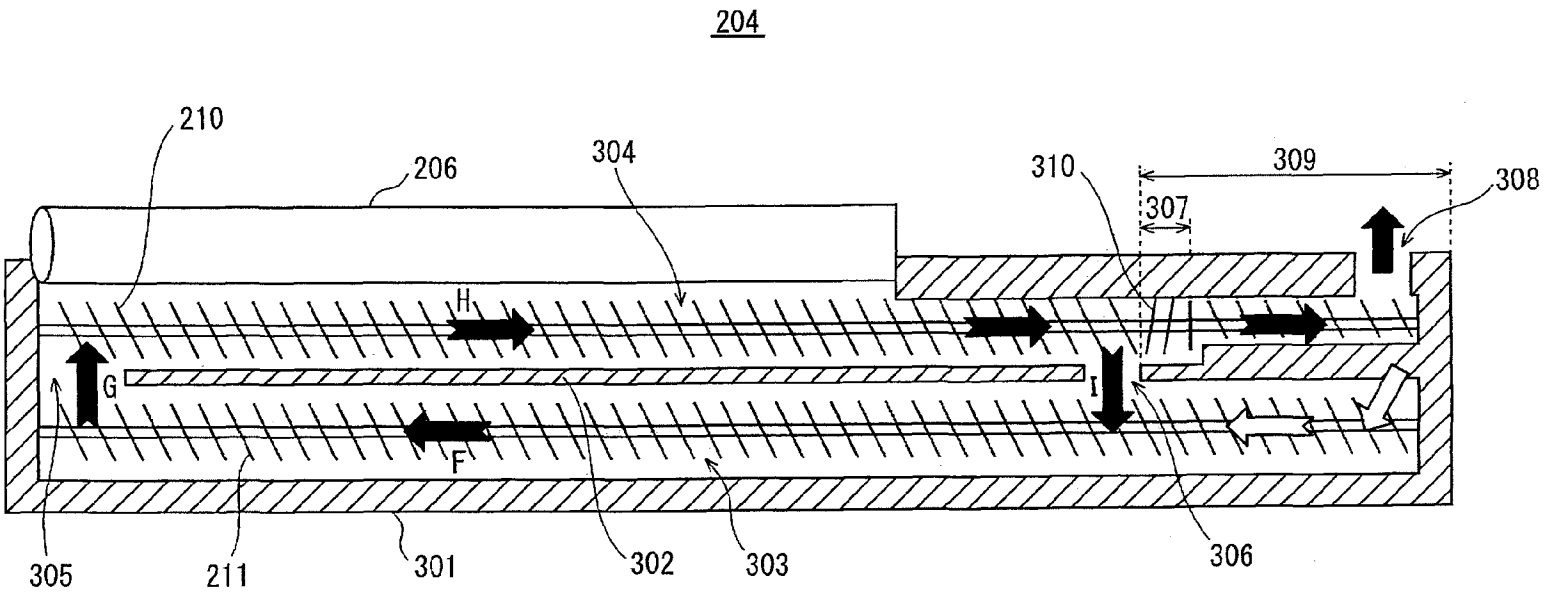
FIG. 3 schematically shows a main structure of a developing device 204.

FIG. 3 is a schematic diagram showing a main structure of the developing device 204. As shown in FIG. 3, the developing device 204 is provided with the housing 301. An inside of the housing 301 is divided into a stirring tank 303 and a supplying tank 304 by a partition 302, and the housing 301 houses developer including toner and carriers. The stirring screw 211 is provided within the stirring tank 303, stirs the toner and carriers while conveying the toner and carriers in a direction of an arrow F, and triboelectrically charges the toner. At the most downstream end of the stirring tank 303 in the direction of the arrow F, the partition 302 is provided with an upflow opening 305 through which the developer moves up from the stirring tank 303 to the supplying tank 304 in a direction of an arrow G.

A supplying screw 210 is provided within the supplying tank 304, and supplies the developer including the charged toner to the developing roller 206 while conveying the developer in a direction of an arrow H. Thereafter, remained developer moves down from the supplying tank 304 to the stirring tank 303 in a direction of an arrow I through a downflow opening 306 provided on the partition 302 in the most downstream end of the supplying tank 304 in the direction of the arrow H. The supplying screw 210 and the stirring screw 211 are each a spiral screw that is a shaft on which spiral vanes are formed at a predetermined pitch along almost the entire range thereof. In addition, the developing roller 206, the supplying screw 210, and the stirring screw 211 are placed such that a rotation axis of the developing roller 206, and rotation shafts of the supplying screw 210 and the stirring screw 211 are in parallel with one another.

The downstream side of the stirring tank 303 in a conveying direction of the developer (in the direction of the arrow F) connects to the upstream side of the supplying tank 304 in a conveying direction of the developer (in the direction of the arrow H). Accordingly, the developer is conveyed in the direction of the arrow G. Also, the downstream side of the supplying tank 304 in the conveying direction of the developer (in the direction of the arrow H) connects to the upstream side of the stirring tank 303 in the conveying direction of the developer (in the direction of the arrow F). Accordingly, the developer is conveyed in the direction of the arrow I. Thereby, the developer is conveyed to circulate within the housing 301.

The upstream side of the stirring tank 303 in the conveying direction of the developer is provided with a developer inlet.

The developer that has been supplied from the toner cartridge 101K through a hopper (unillustrated) to a supply opening (unillustrated) is conveyed in a direction of white arrows in FIG. 3 to flow into the stirring tank 303. In addition, the downstream side of the supplying tank 304 in the conveying direction of the developer (in the direction of the arrow H) is provided with a developer discharge unit 309.

The upstream side of the developer discharge unit 309 in the conveying direction of the developer acts as a reverse flow generating unit 307, and provided with a reverse flow generating screw 310 that pushes the developer in a direction opposite to the conveying direction of the developer. The reverse flow generating screw 310 has a rotation shaft common to the supplying screw 210. The developer discharge unit 309 is provided with a developer discharge opening 308 to discharge an excessive amount of developer. The discharged developer is collected in an unillustrated collection box.

Figure 4:
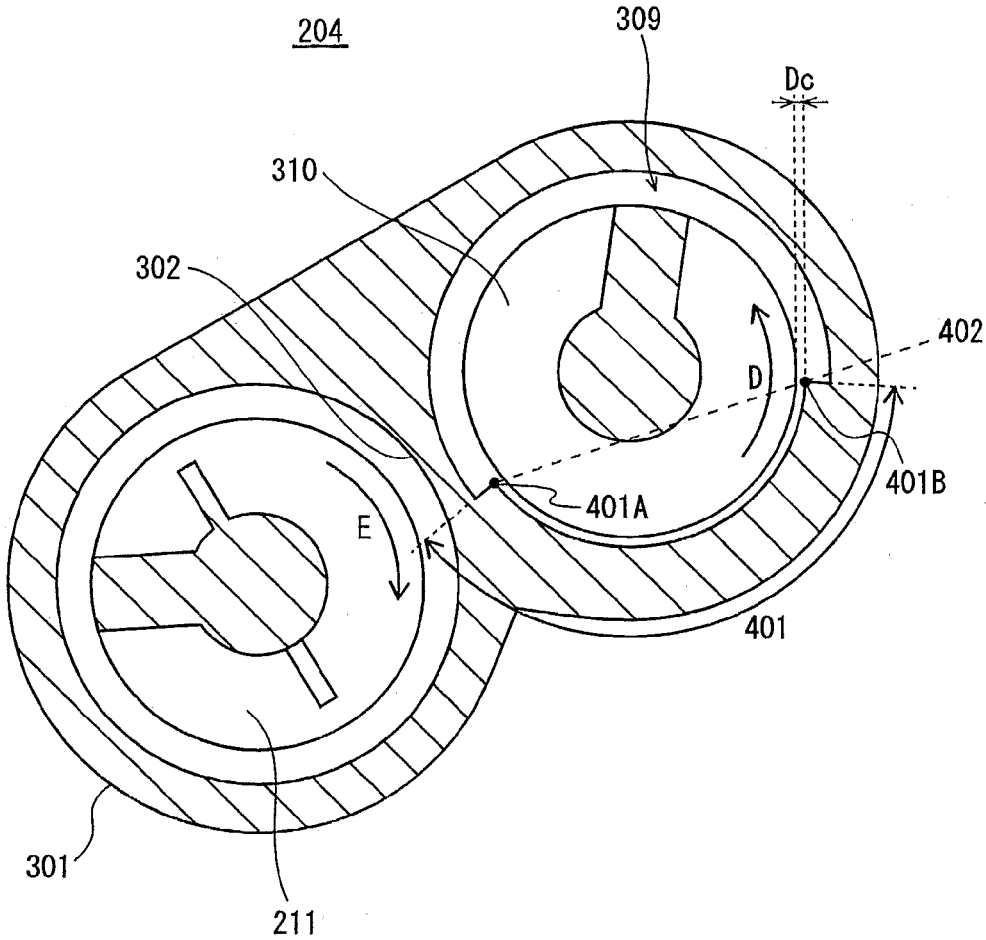
FIG. 4 is a cross-section diagram showing a main structure of a reverse flow generating unit 307.

FIG. 4 is a cross-section diagram showing a main structure of a reverse flow generating unit 307. FIG. 4 shows a cross-section taken along a plain perpendicular to the rotation shaft of the reverse flow generating screw 310.

As shown in FIG. 4, at the reverse flow generating unit 307, a distance between the inner wall of the housing 301 and the reverse flow generating screw 310 is reduced in an area 401 (hereinafter, referred to as "reduced-radius area") whose height is lower, in the direction of gravity, than the height of the surface 402 (hereinafter, referred to as "initial surface") of the developer when the developing unit 204 is supplied with developer in an amount initially supplied. The surface 402 matches a virtual line connecting the upstream end 401A of the area 401 and the downstream end 401B of the area 401. In the present embodiment, a distance Dc between the reverse flow generating screw 310 and the inner wall of the housing 301 in the reduced-radius area 401 is 1.0 mm. In addition, the radius of rotation of the reverse flow generating screw 310 is 11 mm.

Thereby, it becomes more difficult for the developer to pass through the reverse flow generating unit 307. Accordingly, the amount of discharged developer can be reduced. When the amount of developer in the developing device 204 increases and the height of the surface of developer becomes higher than the initial surface 402, the developer passes through an area where a distance between the reverse flow generating screw 310 and the inner wall of the housing 301 is wider. Accordingly, the developer is discharged more easily. As a result, the amount of developer in the developing unit 204 is maintained constant.

The initial surface 402 is not horizontal. In accordance with rotation of the reverse flow generating screw 310 in a direction of an arrow D, the surface of the initial surface 402 is inclined such that, in the direction of the arrow D, the downstream side of the surface is high and the upstream side of the surface is low. Thereby, the downstream side of the reduced-radius area 401 is also higher than the upstream side thereof in the direction D.

[3] EXPERIMENTS FOR CONFIRMATION

In accordance with various conditions, experiments have been conducted to confirm how a stable amount of developer (an amount of developer when supply and consumption of the developer balance) of the developing device 204 pertaining to the present embodiment changes. The following describes results of the experiments.

Figure 5:
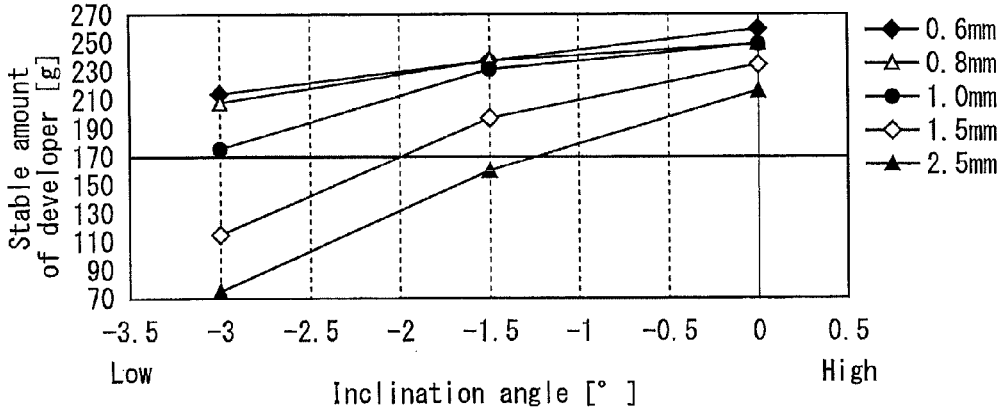
FIG. 5 is a graph showing a stable amount of developer when the inclination angle of the developing device 204 in an axial direction of the rotation shaft of a supplying screw 210 and a distance Dc between an inner wall of a housing 301 and a reverse flow generating screw 310 are changed.

FIG. 5 is a graph showing the stable amount of developer when the inclination angle of the developing device 204 in an axial direction of the rotation shaft of the supplying screw 210 and the distance Dc are changed. Note that the initial amount of developer was 170 g and the system speed was 250 mm/second. As shown in FIG. 5, in the case where the distance Dc was set to 2.5 mm, when the developing device 204 was inclined at an angle of −1.5 degrees so that the developer discharge opening 308 became low, the stable amount of developer was well below the initial amount of developer. Therefore the above case cannot stand up to practical use.

On the other hand, in the case where the distance Dc was set to 1.5 mm, even when the inclination angle was −1.5 degrees, the stable amount of developer did not reduce so much compared with the case where the distance Dc was 2.5 mm. Therefore, it is thought that such a case can stand up to practical use. In addition, in the case where the distance was set to be equal to or less than 1.0 mm, the stable amount of developer exceeded the initial amount of the developer at any case. Therefore, superior image quality can be expected, and such cases are preferable.

Figure 6:
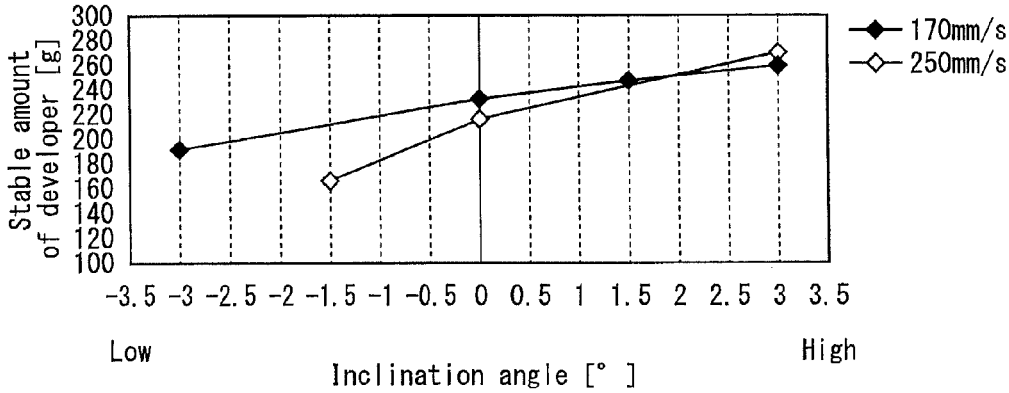
FIG. 6 is a graph showing the stable amount of developer for each system speed when the distance Dc between the inner wall of the housing 301 and the reverse flow generating screw 310 is set to 2.5 mm and the inclination angle is changed.
Figure 7:
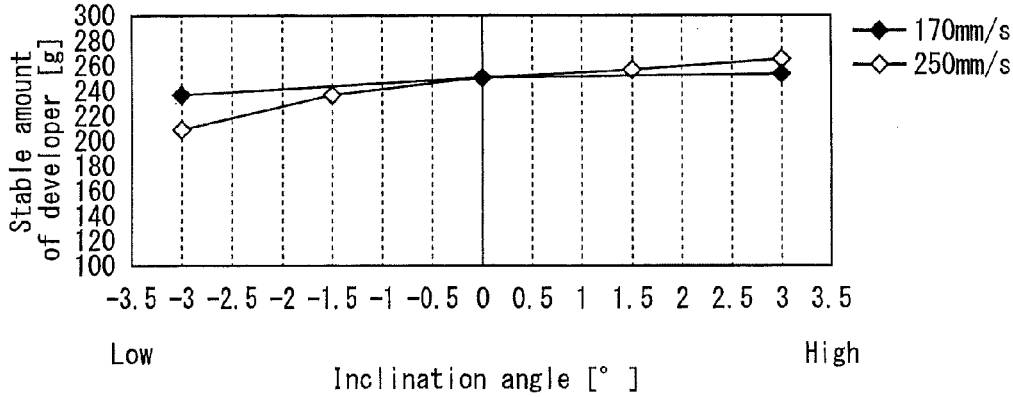
FIG. 7 is a graph showing the stable amount of developer for each system speed when the distance Dc between the inner wall of the housing 301 and the reverse flow generating screw 310 is set to 0.8 mm and the inclination angle is changed.

FIG. 6 is a graph showing the stable amount of developer for each system speed when the distance Dc is set to 2.5 mm and the inclination angle is changed. FIG. 7 is a graph showing the stable amount of developer for each system speed when the distance Dc is set to 0.8 mm and the inclination angle is changed. As shown in FIG. 6, in the case where the distance Dc was set to 2.5 mm, a change in the stable amount of developer increased especially when the system speed was high (250 mm/second).

On the other hand, as shown in FIG. 7, in the case where the distance Dc was set to 0.8 mm, a change in the stable amount of developer was small regardless of the system speed. In other words, even in the case where the system speed was set to 250 mm/second and the inclination angle was ±3 degrees, a change in the stable amount of the developer is extremely small. Therefore, stability of the stable amount of developer can be sufficiently guaranteed even if the device is influenced by other environmental factors.

Note that even in the case where one side of the developing device provided with the developer discharge opening 308 was high (inclination angle was −3 degrees), the stable amount of the developer was substantially the same as the stable amount of the developer in the case where the distance Dc was set to 2.5 mm. Therefore, even when the distance Dc was set to be small, the amount of discharged developer is not deficient. In addition, in the present embodiment, the rotation shaft of the reverse flow generating screw 310 is made of polycarbonate resin, and the tolerance of the radius of rotation of the reverse flow generating screw 310 is 0.8 mm. Accordingly, the distance Dc cannot be set to less than 0.8 mm. However, when the tolerance of the radius of rotation of the reverse flow generating screw 310 is smaller than 0.8 mm, it is possible to enhance the effect of the present invention by lessening the distance Dc in accordance with the tolerance.

[4] MODIFICATION

The present invention has been described based on the above-described embodiment. However, it is natural that the contents of the present invention are not limited to the above-described embodiment. For example, the following modifications are possible.

(1) The above-described embodiment has described the case where the distance between the inner wall of the housing 301 and the reverse flow generating screw 310 is reduced in the reduced-radius area 401 whose height is lower than the height of the initial surface 402 in the direction of gravity. However, it is obvious that the present invention is not limited to this, and the following alternative is also possible.

Figure 8:
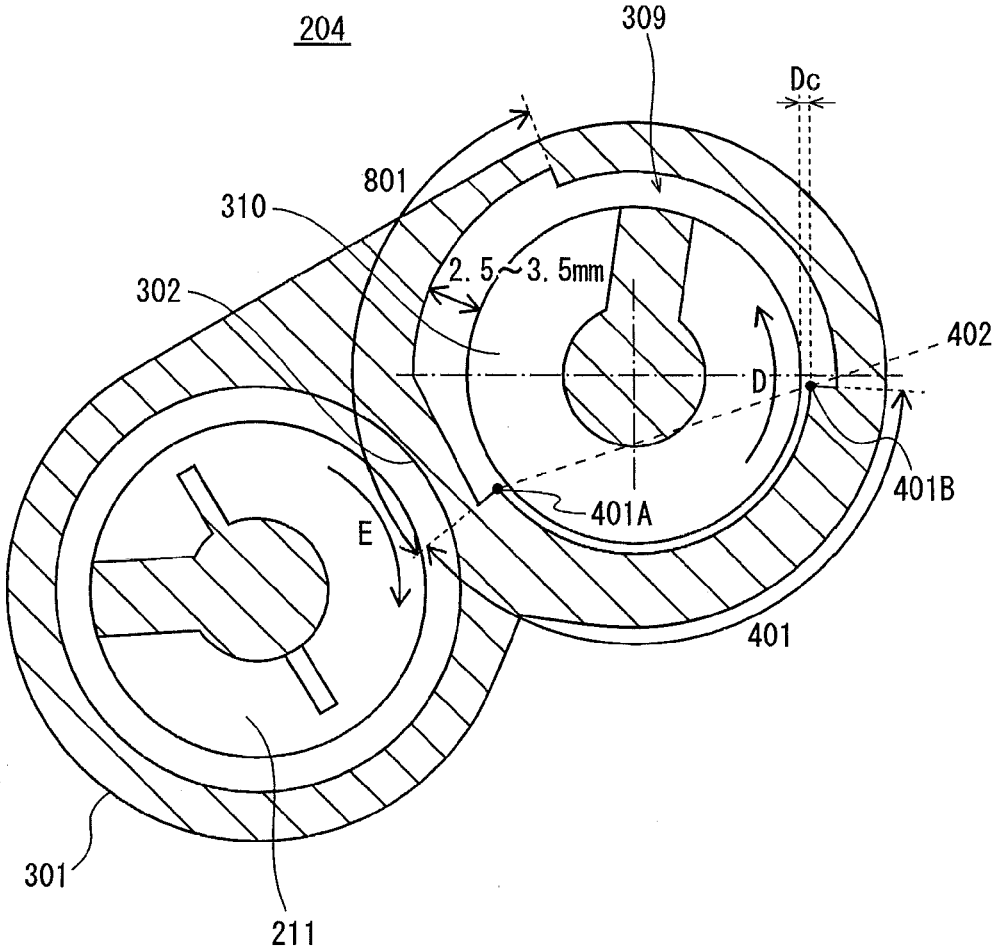
FIG. 8 is a cross-section diagram showing a main structure of a reverse flow generating unit 307 pertaining to a modification of the present invention.

FIG. 8 is a cross-section diagram showing a main structure of a reverse flow generating unit 307 pertaining to the present modification. In FIG. 8, dashed dotted lines indicate a vertical line and a horizontal line each traversing the center of rotation of the reverse flow generating screw 310. As shown in FIG. 8, a distance between the inner wall of the housing 301 and the reverse flow generating screw 310 is enlarged (hereinafter, referred to as "enlarged-radius area") at a position further upstream than the upstream end of the reduced-radius area 401 in a rotation direction of the reverse flow generating screw 310. The distance between the inner wall of the housing 301 and the reverse flow generating screw 310 is approximately 2.5-3.5 mm at the enlarged-radius area 801.

Thereby, even when the amount of developer in the developing device 204 increases for some reason, the developer is speedily discharged via the enlarged-radius area. Accordingly, the amount of developer in the developing unit 204 can be stabilized. In addition, since a discharge start position is provided at the upstream side of the rotation direction of the reverse flow generating screw 310, a difference due to inertia force in the rotation direction is reduced. In this sense, the amount of developer in the developing device 204 can be stabilized.

(2) The above-described embodiment has described the case where the tolerance of the radius of rotation of the reverse flow generating screw 310 is 0.8 mm. However, it is obvious that the present invention is not limited to this, and when the tolerance of the radius of rotation of the reverse flow generating screw 310 is greater than 1.0 mm, the following structure is acceptable.

Figure 9:
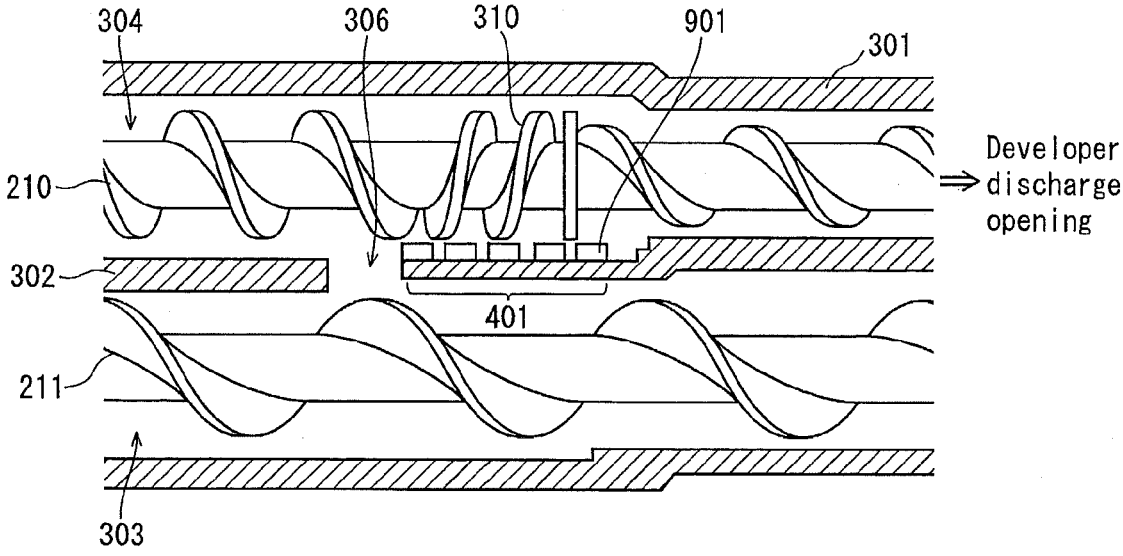
FIG. 9 is a cross-section diagram showing a structure of the developing device 204 pertaining to a modification of the present invention.

FIG. 9 is a cross-section diagram showing a structure of the developing device 204 pertaining to the present modification. As shown in FIG. 9, at the reduced-radius area 401 of the reverse flow generating unit 307, the inner wall of the housing 301 is provided with a plurality of ribs 901. The ribs 901 are each approximately 1 mm in height, and are provided at an equal interval of approximately 1 mm along the axial direction of the rotation shaft of the reverse flow generating screw 310. Each of the ribs 901 is each provided over the entire reduced-radius area 401 along the rotation direction of the reverse flow generating screw 310. Providing the ribs 901 in this way improves the effect of narrowing the gap between the inner wall of the housing 301 and the reverse flow generating screw 310.

Figure 10:
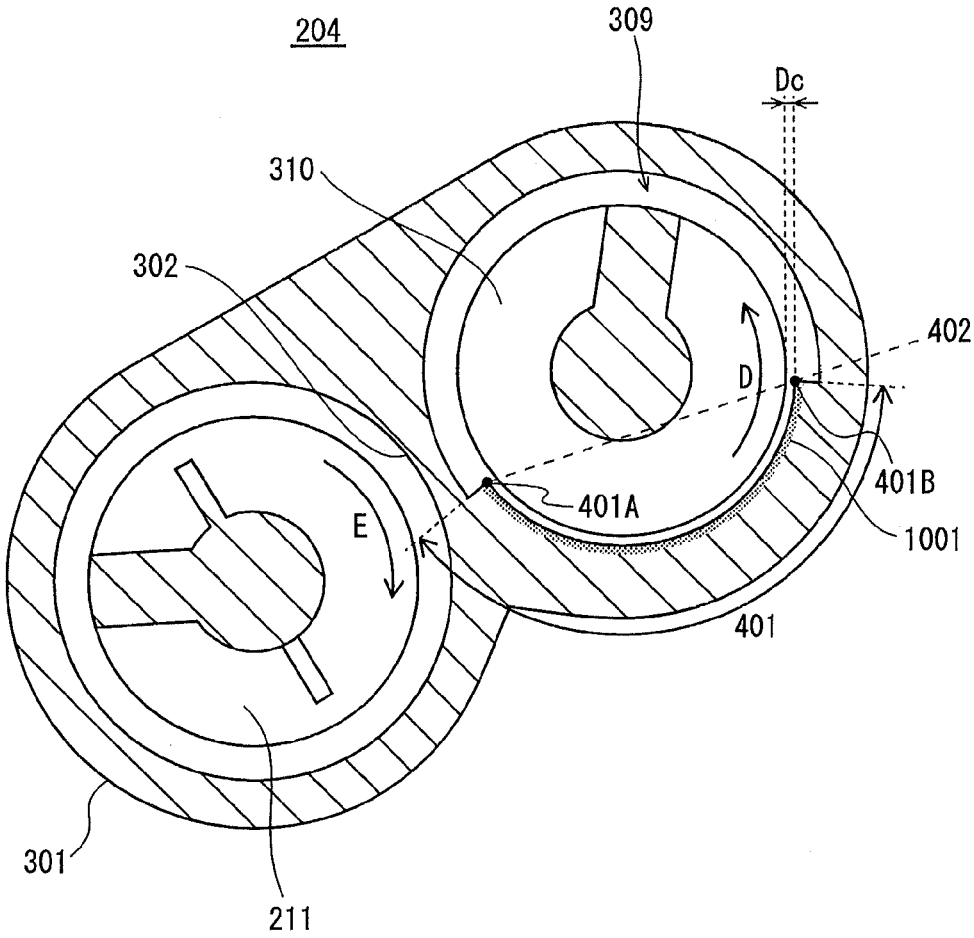
FIG. 10 is a cross-section diagram showing a structure of the developing device 204 pertaining to a modification of the present invention.

FIG. 10 is a cross-section diagram showing a structure of the developing device 204 pertaining to another modification. As shown in FIG. 10, making a surface roughness of a surface portion 1001 of the reduced-radius area 401 greater than surface roughness of the remaining area of the inner wall of the housing 301 improves the effect of narrowing the gap between the inner wall and the reverse flow generating screw 310. In this case, the surface roughness Rz is preferably in a range of 10-20 μm, inclusive. Note that the Rz indicates so-called ten point height of irregularities. The ten-point height of irregularities is defined as the following sum of the mean value of the absolute values the five highest peaks (Yp) and the mean value of the absolute values of the five deepest valleys (Yv) measured from the mean line that indicates the average value within the range L extracted from the roughness curve in a direction of the mean line.

$$Rz = \frac{|Yp1 + Yp2 + Yp3 + Yp4 + Yp5| + |Yz1 + Yz2 + Yz3 + Yz4 + Yz5|}{5}$$

Figure 11:
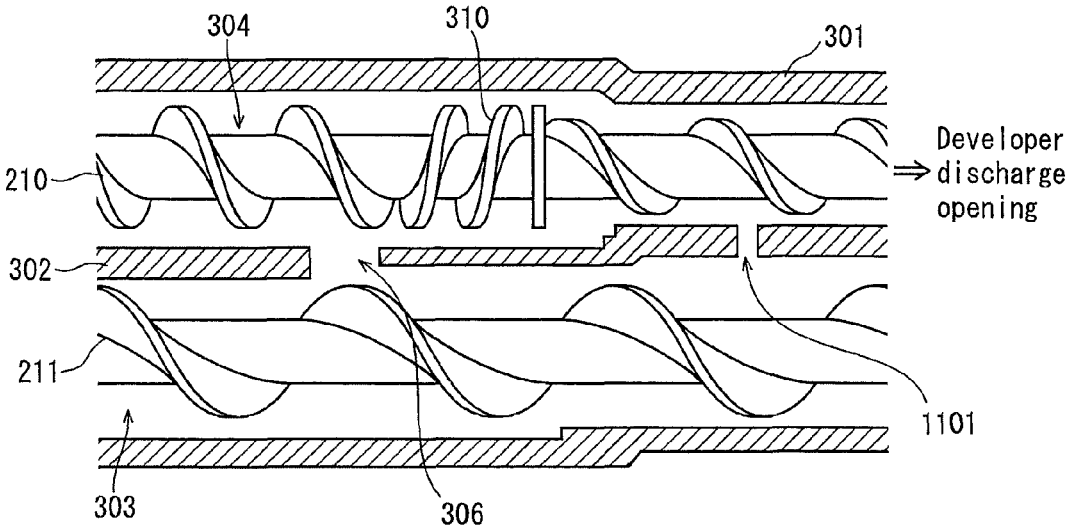
FIG. 11 is a cross-section diagram showing a structure of the developing device 204 pertaining to a modification of the present invention.

FIG. 11 is a cross-section diagram showing a structure of the developing device 204 pertaining to another modification. As shown in FIG. 11, a small opening 1101 is provided on a path from the reverse flow generating unit 307 to the developer discharge opening 308 to return the developer to the stirring tank 303. As a result, the amount of discharged developer can be reduced. In other words, by providing the small opening 1101 like this, the developer that has reached a discharge path due to a high system speed even though the amount of developer in the device is not large returns to the stirring tank 303 without being discharged.

On the other hand, when the amount of developer in the device is large, while a part of the developer that has reached the discharge path returns to the stirring tank 303 through the small opening 1101, a surplus amount of developer is discharged through the developer discharge opening 308. Thereby, it enables a change in the stable amount of developer due to a change in a system speed to be suppressed. Note that the small opening 1101 may have an area of, for example, 2-4 $mm^2$.

Thereby, the amount of developer can be stabilized even when the distance. Dc between the inner wall of the housing 301 and the reverse flow generating screw 310 cannot be set to be equal to or less than 1.0 mm.

(3) Although not mentioned in the above-described embodiment, in the case where chemical toner having the smooth surface and high fluidity is used, the developer more easily passes through the reverse flow generating unit 307 due to inertia force when a system speed is high, compared with the case where ground toner is used. Accordingly, the present invention is effective when chemical toner having the smooth surface and the high fluidity is used, especially when toner whose shape factor is equal to or less than 140. Note that a shape factor of toner is calculated by the following equation.

$$\text{Shape Factor} = \left(\frac{(\text{maximum toner diameter})^2}{\text{projected area of toner}}\right) \times \left(\frac{100\pi}{4}\right)$$

(4) Although not mentioned in the above-described embodiment, by providing the reduced-radius area over at least one pitch of the reverse flow generating screw 310 in the axial direction of the rotation shaft of the reverse flow generating screw 310, developer can be reliably pushed back. If the reduced-radius area is less than one pitch, an effect of pushing back developer may be reduced depending on the rotation angle (phase) of the reverse flow generating screw 310. Accordingly, the length of the reduced-radius area in the axial direction of the rotation shaft of the reverse flow generating screw 310 has to be determined in accordance with a force needed to push back the developer.

(5) The above-described embodiment has described the case where the distance between the inner wall of the housing 301 and the reverse flow generating screw 310 is reduced in the reduced-radius area 401 whose height is lower than the height of the initial surface 402 in the direction of gravity. This stabilizes the amount of developer in the developing unit 204 substantially at the initial amount of the developer. Accordingly, in the case where the amount of developer is stabilized at an amount different from the initial amount, the reduced-radius area may be determined in accordance with the stable amount of developer.

In other words, in order to stabilize the amount of developer at less than the initial amount, the reduced-radius area 401 may be narrower than the above-described embodiment. In addition, in order to stabilize the amount of developer at greater than the initial amount, the reduced-radius area 401 may be wider than the above-described embodiment.

(6) The above-described embodiment has described a multi function peripheral (MFP) as an example. However, it is obvious that the present invention is not limited to this, and the effect thereof can be achieved by applying the above embodiment to a single-function machine such as a printer, a copier and a facsimile apparatus, or a monochrome apparatus.

[5] CONCLUSION

As a conclusion, main features of the present invention are described below.

The developing device pertaining to the present invention is a trickle-type developing device that receives supply of two-component developer including toner, supplies the toner to a photoreceptor, and develops an electrostatic latent image formed on the photoreceptor, the developing device comprising: a stirring and conveying tank provided with stirring and conveying screws that stir, convey and circulate the developer; a hollow cylindrical discharge member via which a part of the developer is conveyed from the stirring and conveying tank to a discharge opening through which the part of the developer is discharged from the discharge member, the discharge opening being provided in the discharge member; and a reverse flow generating screw provided inside a portion of the discharge member, sharing one of rotation shafts of the stirring and conveying screws, and pushing back a part of the developer in a direction from the discharge opening toward the stirring and conveying tank, wherein the portion has a reduced-radius part and in a cross section thereof perpendicular to an axial direction of the one of rotation shafts of the stirring and conveying screws, an inner radius of the portion is smaller in the reduced-radius part than in the remaining part of the portion, the reduced-radius part being located in a lower part of the portion with respect to a vertical direction of the portion.

In this way, an amount of discharged developer can be stabilized regardless of the system speed, since a power to push back developer is enhanced by reducing a radius of the lower side of the discharge path in a perpendicular direction thereof at a location provided with a reverse flow generating member. Accordingly, the amount of developer in the developing device can be stabilized, and then superior image quality is realized regardless of the system speed.

In this case, it is preferable that when developer is conveyed in an amount supplied upon manufacturing, in the portion, a level of the developer is at or below a virtual line connecting an upstream end of the reduced-radius part and a downstream end of the reduced-radius part in a rotation direction of the reverse flow generating screw, in the cross section. Also, as indicated by the result of the experiment described above, it is preferable that an outer circumferential edge of the reverse flow generating screw and an inner wall of the reduced-radius part have a gap therebetween in a range of 0.8 mm to 1.5 mm, inclusive.

Also, if the portion includes an enlarged-radius part provided in a location that is different from a location of the reduced-radius part and that is further upstream than an upstream end of the reduced-radius part in a rotation direction of the reverse flow generating screw, and in the location of the enlarged-radius part, the portion has an enlarged inner radius, it is possible to adjust an amount of developer when developer starts to be discharged. Furthermore, the amount of developer in the device can be stabilized. In this case, it is preferable that an upstream end of the enlarged-radius part and the upstream end of the reduced-radius part define a central angle therebetween substantially in a range of 0 degrees to 90 degrees, inclusive, the central angle being formed between a straight line connecting the upstream end of the enlarged-radius part and the center of the rotation shaft of the reverse flow generating screw and a straight line connecting the upstream end of the reduced-radius part and the center of the rotation shaft, the straight lines extending radially from the rotation shaft, and an outer circumferential edge of the reverse flow generating screw and an inner wall of the enlarged-radius part have a gap therebetween in a range of 2.5 mm to 3.5 mm, inclusive.

When there is a limit to how much the radius can be reduced, an inner wall of the reduced-radius part may have a surface roughness greater than a surface roughness of an inner wall of the remaining part of the discharge member. This also yields the advantageous effect of stabilizing the amount of developer. Note that in this case, it is preferable that the inner wall of the reduced-radius part has a surface roughness Rz in a range of 10 μm to 20 μm, inclusive.

Also, a similar effect may be obtained when a plurality of ribs are provided on an inner wall of the reduced-radius part. In this case, it is preferable that the plurality of ribs are each approximately 1 mm in height.

Also, the discharge member is further provided with a return opening through which a part of the developer passing through the discharge member returns to the stirring and conveying tank. This also realizes superior image quality by stabilizing the amount of developer in the developing device.

An image forming apparatus pertaining to the present invention is characterized in including the developing device pertaining to the present invention. This yields the above advantageous effects.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A trickle-type developing device that receives supply of two-component developer including toner, supplies the toner to a photoreceptor, and develops an electrostatic latent image formed on the photoreceptor, the developing device comprising:

a stirring and conveying tank provided with stirring and conveying screws that stir, convey and circulate the developer;

a hollow cylindrical discharge member via which a part of the developer is conveyed from the stirring and conveying tank to a discharge opening through which the part of the developer is discharged from the discharge member, the discharge opening being provided in the discharge member; and a reverse flow generating screw provided inside a portion of the discharge member, sharing one of rotation shafts of the stirring and conveying screws, and pushing back a part of the developer in a direction from the discharge opening toward the stirring and conveying tank, wherein the portion has a reduced-radius part and in a cross section thereof perpendicular to an axial direction of the one of rotation shafts of the stirring and conveying screws, an inner radius of the portion is smaller in the reduced-radius part than in the remaining part of the portion, the reduced-radius part being located in a lower part of the portion with respect to a vertical direction of the portion.

2. The developing device of claim 1, wherein when developer is conveyed in an amount supplied upon manufacturing, in the portion, a level of the developer is at or below a virtual line connecting an upstream end of the reduced-radius part and a downstream end of the reduced-radius part in a rotation direction of the reverse flow generating screw, in the cross section.

3. The developing device of claim 1, wherein an outer circumferential edge of the reverse flow generating screw and an inner wall of the reduced-radius part have a gap therebetween in a range of 0.8 mm to 1.5 mm, inclusive.

4. The developing device of claim 1, wherein the portion includes an enlarged-radius part provided in a location that is different from a location of the reduced-radius part and that is further upstream than an upstream end of the reduced-radius part in a rotation direction of the reverse flow generating screw, and in the location of the enlarged-radius part, the portion has an enlarged inner radius.

5. The developing device of claim 4, wherein an upstream end of the enlarged-radius part and the upstream end of the reduced-radius part define a central angle therebetween substantially in a range of 0 degrees to 90 degrees, inclusive, the central angle being formed between a straight line connecting the upstream end of the enlarged-radius part and the center of the rotation shaft of the reverse flow generating screw and a straight line connecting the upstream end of the reduced-radius part and the center of the rotation shaft, the straight lines extending radially from the rotation shaft, and an outer circumferential edge of the reverse flow generating screw and an inner wall of the enlarged-radius part have a gap therebetween in a range of 2.5 mm to 3.5 mm, inclusive.

6. The developing device of claim 1, wherein an inner wall of the reduced-radius part has a surface roughness greater than a surface roughness of an inner wall of the remaining part of the discharge member.

7. The developing device of claim 6, wherein the inner wall of the reduced-radius part has a surface roughness Rz in a range of 10 μm to 20 μm, inclusive.

8. The developing device of claim 1, wherein a plurality of ribs are provided on an inner wall of the reduced-radius part.

9. The developing device of claim 8, wherein the plurality of ribs are each approximately 1 mm in height.

10. The developing device of claim 1, wherein the discharge member is further provided with a return opening through which a part of the developer passing through the discharge member returns to the stirring and conveying tank.

11. An image forming apparatus comprising:

a trickle-type developing device that receives supply of two-component developer including toner, supplies the toner to a photoreceptor, and develops an electrostatic latent image formed on the photoreceptor, the developing device including:

a stirring and conveying tank provided with stirring and conveying screws that stir, convey and circulate the developer;

a hollow cylindrical discharge member via which a part of the developer is conveyed from the stirring and conveying tank to a discharge opening through which the part of the developer is discharged from the discharge member, the discharge opening being provided in the discharge member; and a reverse flow generating screw provided inside a portion of the discharge member, sharing one of rotation shafts of the stirring and conveying screws, and pushing back a part of the developer in a direction from the discharge opening toward the stirring and conveying tank, wherein the portion has a reduced-radius part and in a cross section thereof perpendicular to an axial direction of the one of rotation shafts of the stirring and conveying screws, an inner radius of the portion is smaller in the reduced-radius part than in the remaining part of the portion, the reduced-radius part being located in a lower part of the portion with respect to a vertical direction of the portion.

12. The image forming apparatus of claim 11, wherein when developer is conveyed in an amount supplied upon manufacturing, in the portion, a level of the developer is at or below a virtual line connecting an upstream end of the reduced-radius part and a downstream end of the reduced-radius part in a rotation direction of the reverse flow generating screw, in the cross section.

13. The image forming apparatus of claim 11, wherein an outer circumferential edge of the reverse flow generating screw and an inner wall of the reduced-radius part have a gap therebetween in a range of 0.8 mm to 1.5 mm, inclusive.

14. The image forming apparatus of claim 11, wherein the portion includes an enlarged-radius part provided in a location that is different from a location of the reduced-radius part and that is further upstream than an upstream end of the reduced-radius part in a rotation direction of the reverse flow generating screw, and in the location of the enlarged-radius part, the portion has an enlarged inner radius.

15. The image forming apparatus of claim 14, wherein an upstream end of the enlarged-radius part and the upstream end of the reduced-radius part define a central angle therebetween substantially in a range of 0 degrees to 90 degrees, inclusive, the central angle being formed between a straight line connecting the upstream end of the enlarged-radius part and the center of the rotation shaft of the reverse flow generating screw and a straight line connecting the upstream end of the reduced-radius part and the center of the rotation shaft, the straight lines extending radially from the rotation shaft, and an outer circumferential edge of the reverse flow generating screw and an inner wall of the enlarged-radius part have a gap therebetween in a range of 2.5 mm to 3.5 mm, inclusive.

16. The image forming apparatus of claim 11, wherein an inner wall of the reduced-radius part has a surface roughness greater than a surface roughness of an inner wall of the remaining part of the discharge member.

17. The image forming apparatus of claim 16, wherein the inner wall of the reduced-radius part has a surface roughness Rz in a range of 10 μm to 20 μm, inclusive.

18. The image forming apparatus of claim 11, wherein a plurality of ribs are provided on an inner wall of the reduced-radius part.

19. The image forming apparatus of claim 18, wherein the plurality of ribs are each approximately 1 mm in height.

20. The image forming apparatus of claim 11, wherein the discharge member is further provided with a return opening through which a part of the developer passing through the discharge member returns to the stirring and conveying tank.

* * * * *